US008678358B1

(12) United States Patent
Alenzi

(10) Patent No.: US 8,678,358 B1
(45) Date of Patent: Mar. 25, 2014

(54) BUOYANT AERATOR WITH SUPPORT LEGS

(71) Applicant: Bader Shafaqa Alenzi, Abdulla Almubarak (KW)

(72) Inventor: Bader Shafaqa Alenzi, Abdulla Almubarak (KW)

( * ) Notice: Subject to any disclaimer, the term of this patent is extended or adjusted under 35 U.S.C. 154(b) by 0 days.

(21) Appl. No.: 14/077,177

(22) Filed: Nov. 11, 2013

(51) Int. Cl.
*B01F 3/04* (2006.01)

(52) U.S. Cl.
USPC ..... 261/120; 261/122.1; 210/242.2

(58) Field of Classification Search
USPC ..... 261/19, 23.1, 120, 121.1, 122.1, 124; 210/242.2
See application file for complete search history.

(56) References Cited

U.S. PATENT DOCUMENTS

| | | | | | |
|---|---|---|---|---|---|
| 2,827,268 | A | | 3/1958 | Staaf | |
| 3,320,928 | A | * | 5/1967 | Smith | 119/200 |
| 3,856,272 | A | | 12/1974 | Ravitts | |
| 4,030,859 | A | | 6/1977 | Henegar | |
| 4,152,259 | A | * | 5/1979 | Molvar | 210/758 |
| 4,229,302 | A | | 10/1980 | Molvar | |
| 4,268,398 | A | * | 5/1981 | Shuck et al. | 111/101 |
| 4,350,648 | A | * | 9/1982 | Watkins et al. | 261/120 |
| 4,906,359 | A | * | 3/1990 | Cox, Jr. | 210/170.02 |
| 5,510,022 | A | | 4/1996 | Mullis | |
| 7,441,754 | B2 | | 10/2008 | Trentadue et al. | |
| 7,520,493 | B1 | * | 4/2009 | Haldane | 261/120 |
| 8,622,370 | B1 | * | 1/2014 | Alenzi | 261/120 |
| 8,622,371 | B1 | * | 1/2014 | Alenzi | 261/120 |
| 2002/0113013 | A1 | * | 8/2002 | Long et al. | 210/620 |
| 2005/0269262 | A1 | | 12/2005 | McBride | |
| 2007/0039878 | A1 | | 2/2007 | Roberts et al. | |
| 2011/0089098 | A1 | | 4/2011 | Siebert et al. | |
| 2011/0121472 | A1 | * | 5/2011 | Magen | 261/120 |
| 2012/0228216 | A1 | * | 9/2012 | Gavrieli et al. | 210/615 |

FOREIGN PATENT DOCUMENTS

| | | |
|---|---|---|
| GB | 2483527 | 3/2012 |

* cited by examiner

*Primary Examiner* — Charles Bushey
(74) *Attorney, Agent, or Firm* — Richard C. Litman

(57) ABSTRACT

The buoyant aerator with support legs is disposed in a body of water and supplied with air from a remote source. The remote source may be land-based or based upon a floating vessel. An air supply line extends from the remote air source to the aerator, the supply line being supported by one or more rigid poles or columns anchored into the floor of the body of water. The entire aerator structure floats to hold the aerator at a constant level and is held in position by restraining cables. A plurality of rigid support legs extends from the periphery of the float to support the aerator in conditions where the water level drops below the height of the aerator as defined by the vertical distance between the float and the support pads of the legs.

20 Claims, 3 Drawing Sheets

BUOYANT AERATOR WITH SUPPORT LEGS

BACKGROUND OF THE INVENTION

1. Field of the Invention

The present invention relates generally to liquid aeration systems, and more particularly to a buoyant aerator with support legs to support the aerator on the floor of a body of water in conditions of low water levels.

2. Description of the Related Art

The contamination of various bodies of water by various means is an increasingly serious problem worldwide. The most widespread contaminants may be organic materials that enter the water system due to pollution from human habitation, either directly or indirectly, e.g., pollution from farms and the like. Such pollution can affect inland fresh water supplies (lakes and rivers), and can also be carried to the sea by inland rivers and waterways or by direct discharge of sewage and/or other pollutants into the sea. Organic material in the sewage of treatment plants is another example of such pollution, although contained for processing. The biochemical processes that occur in water due to such organic pollution are known to decrease the oxygen content of the water, thereby reducing or even destroying fish and other aquatic life in the contaminated body of water. Even if some fish remain in the polluted water, they are almost certainly unfit for human consumption, if caught.

It is generally considered that the most effective means of eliminating such pollutants in contaminated water is by bacteriological processing, wherein bacteria process the contaminants to break them down into harmless organic materials. However, such bacteria are aerobic, i.e., they require oxygen for their metabolism. This is well known in the sewage treatment field, where water is commonly treated by aeration after solids are removed by settling or other means. Such aeration is generally accomplished by mechanical means, e.g., pumping the water up for dispensing into the air from spray booms and nozzles, or by forcing air through underwater pipes for the air to bubble up through the water. Such mechanical systems are relatively costly to operate and require relatively high energy and manpower costs. Even if such systems were less costly to operate, a huge drawback is that they cannot be readily transported to a pollution site for operation at that site. Rather, the water must be transported to the location of the aeration system, a process that is clearly unworkable on a very large scale and/or over very long distances.

Another consideration is the frequent need to position the air diffuser(s) at a constant depth below the surface of the water in which the aerator is installed in order to simplify pressure regulation of the airflow. This is not a significant problem in settling ponds and the like, but can be a significant problem in bodies of water wherein the level changes from time to time, as in reservoirs with controlled outlets and bodies of water influenced by tidal action.

Thus, a buoyant aerator with support legs solving the aforementioned problems is desired.

SUMMARY OF THE INVENTION

The buoyant aerator with support legs comprises a number of different embodiments, each comprising at least one buoyant aerator for aerating a body of water. Since the aerators are buoyant, the aeration nozzles are deployed at a constant, uniform depth below the surface of the water at all times, regardless of the water level. All of the aerators receive their air supply from a remotely disposed air source. The air source may be based on shore, or may be based upon a ship or other floating vessel. A flexible air supply line or hose extends from the air supply to each of the buoyant aerators, the hose being supported by one or more rigid columns or poles anchored into the bottom of the body of water in which the aerators are placed.

The buoyant aerator has a toroidal float and a plurality of legs extending down from the periphery of the float. A radial array of aeration tubes or nozzles is affixed between the legs and below the float. As the float remains atop the water, the aeration tubes remain at a constant depth below the surface, so that the air supply remains at a constant pressure with no need for variance. A plurality of such buoyant aerators may be placed in a body of water, all of the aerators receiving their air supply from a single remotely located source.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The buoyant aerator with support legs is secured in the body of water in which it is installed and is free floating, but restrained by cables to prevent drifting or moving from its secured location. The aerator receives its air supply from either a land-based or floating vessel-based source. Either of the air supply sources may supply air to a plurality of aerators located remotely from the air supply.

Figure 1:
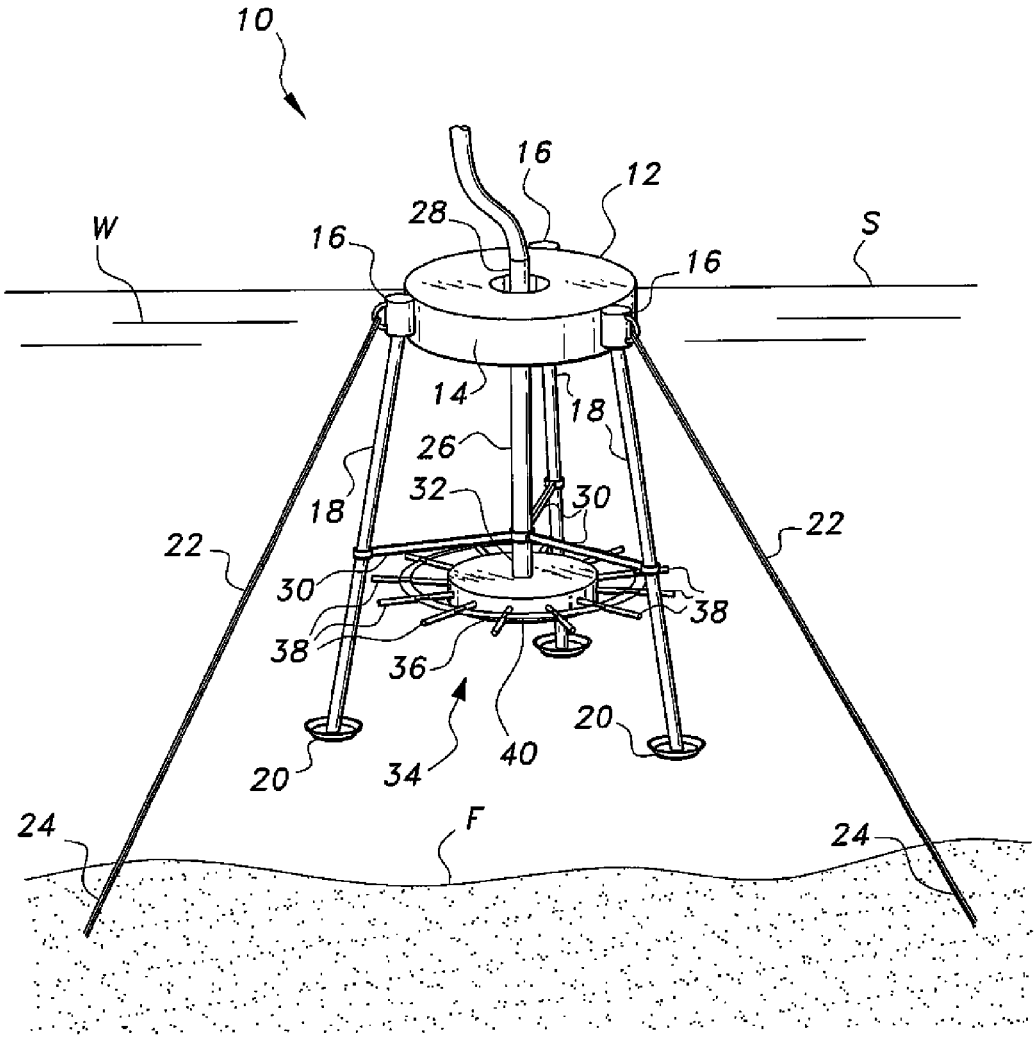
FIG. 1 is a detailed perspective view of a buoyant aerator with support legs according to the present invention, illustrating various details thereof.

FIG. 1 of the drawings provides a perspective view of a buoyant aerator 10. This aerator 10 comprises a buoyant toroidal float 12 having a periphery 14 having a plurality of leg attachment points or fittings 16 installed thereon. Corresponding rigid support legs 18 extend from the fittings. Each leg 18 has a support pad or foot 20 at the base thereof. Corresponding anchor cables or lines 22 extend from the leg attachment points 16. The distal ends 24 of the cables 22 are anchored into the floor F of the body of water W to prevent the aerator 10 from drifting from its installed position. Each of the legs 18 has a fixed length. The support pads 20 remain clear of the floor F of the body of water W when the water depth is greater than the vertical lengths of the legs 18. If the water depth becomes less than the vertical lengths of the legs 18, e.g., due to tidal action, change in level in a reservoir, etc., the support pads 20 rest upon the floor F of the body of water W to support the aerator structure at a predetermined height above the floor F to preclude its contamination with mud or other bottom debris.

The aerator 10 has a single central air delivery column 26 extending substantially vertically through the center hole or passage of the toroidal float 12. The upper end 28 of the column 26 is preferably immovably affixed to the float 12 by suitable braces or the like (not shown) where it passes through the center of the float 12, and by additional similar but longer braces 30 extending from the lower portion or end 32 of the column to each of the support legs 18.

An aeration outlet 34 is immovably affixed to the lower end 32 of the air delivery column 26, and thus to the remaining structure of the aerator 10. The aeration outlet 34 comprises a relatively flat or thin circular central plenum 36 and a plurality of radially disposed and perforated aeration tubes or nozzles 38 extending therefrom. Each of the tubes or nozzles 38 may comprise a single tube, or alternatively, may comprise two concentric tubes, the outer tube extending beyond the outboard end of the inner tube and having a water inlet port(s) at its base. The air exiting the end of the inner tube entrains water entering through the water inlet port in the outer tube to diffuse the aeration bubbles flowing from the device. A circular reinforcement brace 40 is installed concentrically about the plenum 36, tying the aeration tubes 38 together for greater strength. As the aeration outlet 34 is immovably affixed to the remaining structure of the aerator 10, including its float 12, it will be seen that the aeration tubes 38 remain at a constant fixed depth below the float 12. Thus, as the float 12 rides upon the surface of the water (assuming adequate water depth so that the legs 18 are not resting upon the floor F of the body of water W), the aeration tubes 38 also remain at a constant fixed depth below the surface of the water. Since this depth is fixed, the water pressure or head at the depth of the aeration tubes is also fixed, thus requiring a constant air pressure from the air supply of either FIG. 1 or FIG. 2. No adjustment of the air pressure is required for the aerator 10 once the pressure has been set.

Figure 2:
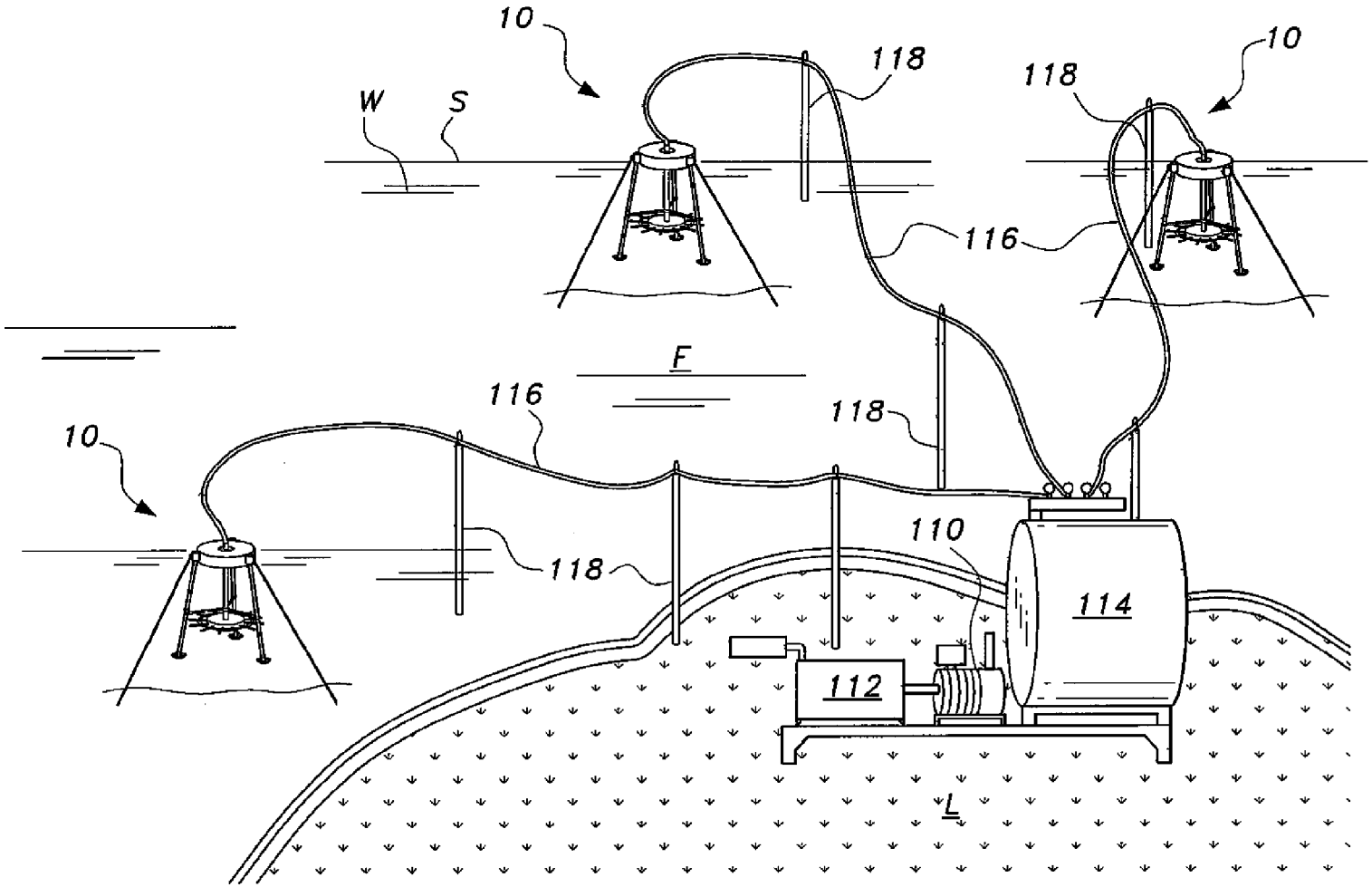
FIG. 2 is an environmental, perspective view of an array of buoyant aerators with support legs according to the present invention, further illustrating a shore-based air supply.

FIG. 2 of the drawings is a pictorial illustration of a first embodiment of a buoyant aerator array, showing a plurality of buoyant aerators with support legs 10 receiving their air supplies from a single land-based source. The source of air for the buoyant aerators includes a compressor 110 driven by a suitable power source 112 (e.g., gasoline or diesel engine, electric motor, etc.). The compressor 110 delivers air to an air tank 114 to supply the offshore buoyant aerators. The compressor 110, power source 112, and air tank 114 are all installed and based upon the shore or land mass L, clear of the water W. Air is delivered to the various aerators by a separate flexible air delivery line 116 extending from the air tank 114 to each of the aerators, so that each aerator has its own air delivery line 116. Each of the delivery lines 116 is supported above the surface S of the water W by one or more support columns 118. Each of the support columns 118 is immovably affixed and anchored in the underlying land mass L or the floor F of the body of water W.

Figure 3:
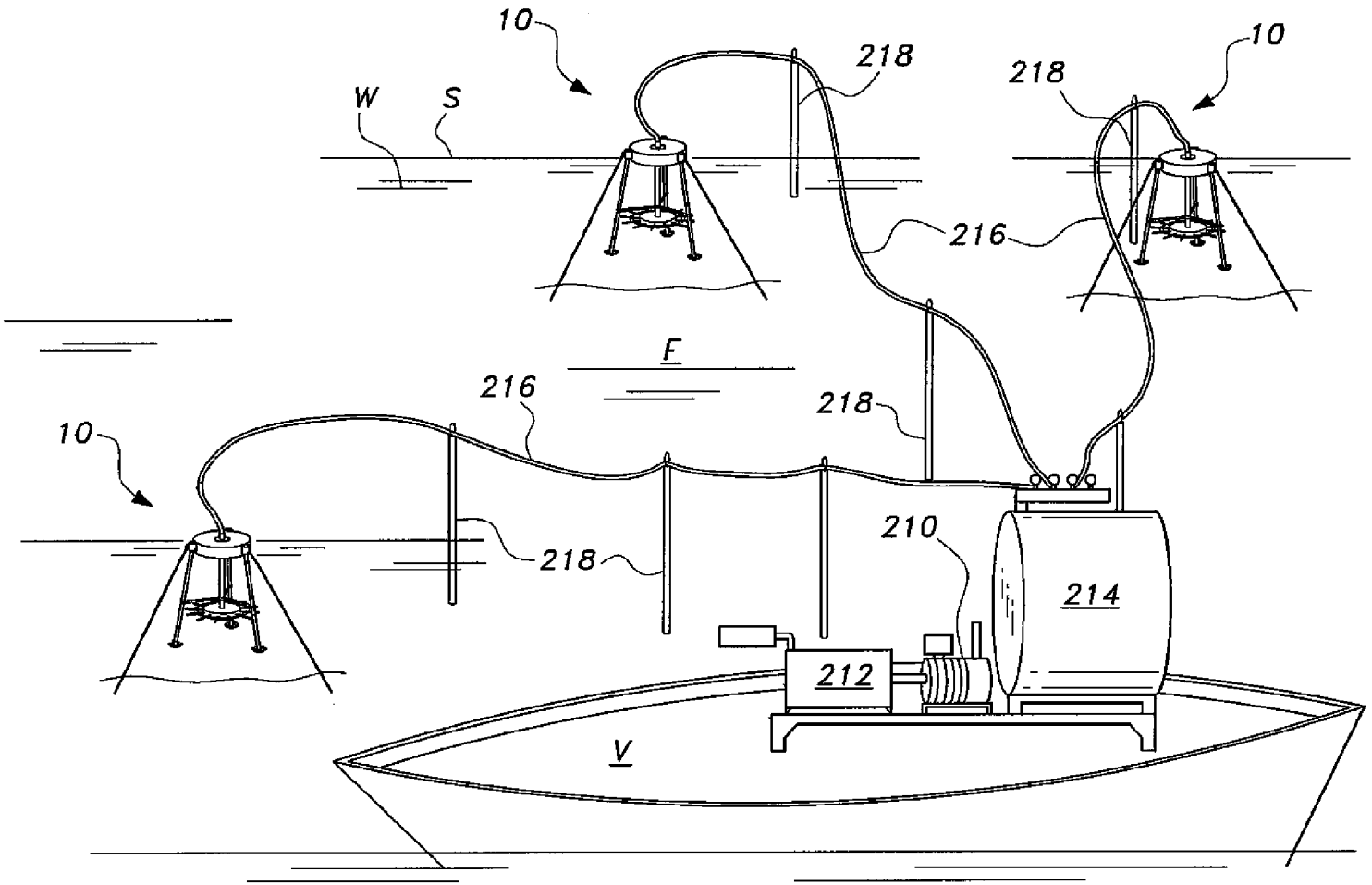
FIG. 3 is an environmental, perspective view of an array of buoyant aerators with support legs according to the present invention, further illustrating an air supply based upon a floating vessel.

FIG. 3 of the drawings is a pictorial illustration of a second embodiment of the buoyant aerator array, showing a plurality of buoyant aerators 10 receiving their air supplies from a single floating vessel-based source. The source of air for the buoyant aerators includes a compressor 210 driven by a suitable power source 212 (e.g., gasoline or diesel engine, electric motor, etc.). The compressor 210 delivers air to an air tank 214 to supply the offshore buoyant aerators. The compressor 210, power source 212, and air tank 214 are all installed and based upon the floating vessel V in the water W. Air is delivered to the various aerators by a separate flexible air delivery line 216 extending from the air tank 214 to each of the aerators, so that each aerator has its own air delivery line 216. Each of the delivery lines 216 is supported above the surface S of the water W by one or more support columns 218. Each of the support columns 218 is immovably affixed and anchored in the floor F of the body of water W.

Either of the above embodiments may support an array of buoyant aerators, as shown in FIGS. 2 and 3. While each of those drawings. shows only three aerators, it will be understood that more aerators may be supplied by a single air source, depending upon the amount of air used by each aerator and the capacity of the air supply.

It is to be understood that the present invention is not limited to the embodiments described above, but encompasses any and all embodiments within the scope of the following claims.

I claim:

1. A buoyant aerator, the aerator being adapted for buoyant placement upon the surface of a body of water, the body of water having a floor and being adjacent to a land mass, the aerator comprising:

a toroidal float having a periphery;

a plurality of support legs, each of the support legs being of fixed length and having an upper attachment end rigidly affixed to the periphery of the float and an opposite lower end;

a flexible anchor cable extending from the upper attachment end of each of the support legs;

a footpad disposed upon the lower end of each of the support legs;

an air delivery column disposed substantially vertically and concentrically through the float, the air delivery column having an upper end and an opposite lower end disposed below the float and above the footpads of the support legs; and an aeration outlet immovably affixed to the lower end of the air delivery column.

2. The aerator according to claim 1, wherein the aerator has three equally spaced support legs of fixed length, the aeration outlet comprising a plurality of radially disposed tubes.

3. The aerator according to claim 1, further comprising:

an air supply remotely disposed from the air delivery column; and an air delivery line extending from the air supply to the upper end of the air delivery column.

4. The aerator according to claim 3, further comprising at least one support column supporting each air delivery line, the at least one support column being anchored and immovably affixed.

5. The buoyant aerator according to claim 3, wherein the air supply is disposed upon the adjacent land mass and remote from the aerator, the air supply comprising a compressor, a power source selectively driving the compressor, and an air tank, the air supply being disposed above the surface of the water and clear of the water.

6. The buoyant aerator according to claim 3, further comprising a floating vessel remotely disposed from the aerator, the air supply being disposed upon the floating vessel and remote from the aerator, the air supply comprising a compressor, a power source selectively driving the compressor, and an air tank, the single air supply being disposed above the surface of the water and clear of the water.

7. The buoyant aerator according to claim 1, wherein the aeration outlet comprises a central plenum having a plurality of aeration tubes extending radially therefrom and a concentric reinforcement brace connecting the tubes to one another.

8. A buoyant aerator array, the array having a plurality of aerators adapted for buoyant placement upon the surface of a body of water, the body of water having a floor and being adjacent to a land mass, each of the aerators of the aerator array comprising:

a toroidal float having a periphery;

three equally spaced support legs depending from the float periphery, each of the support legs having an upper attachment end and an opposite lower end;

a flexible anchor cable extending from the upper attachment end of each of the support legs;

a footpad disposed upon the lower end of each of the support legs;

an air delivery column disposed substantially vertically and concentrically through the float, the air delivery column having an upper end and an opposite lower end disposed below the float and above the footpads of the support legs; and an aeration outlet immovably affixed to the lower end of the air delivery column, the aeration outlet having a plenum, a plurality of radially disposed tubes extending from the plenum, and a concentric reinforcement brace connecting the tubes to one another.

9. The buoyant aerator array according to claim 8, wherein each of the support legs has a fixed length, the upper attachment end of each of the support legs being rigidly affixed to the periphery of the float.

10. The buoyant aerator array according to claim 8, further comprising:

an air supply remotely disposed from the air delivery column; and a plurality of air delivery lines extending from the air supply, each of the aerators having a corresponding one of the delivery lines connected to the upper end of the air delivery column.

11. The buoyant aerator array according to claim 10, further comprising at least one support column supporting each said air delivery line, the support columns being anchored and immovably affixed.

12. The buoyant aerator array according to claim 10, wherein:

the air supply is disposed upon the land mass remote from the aerator array, the air supply including a compressor, a power source selectively driving the compressor, and an air tank, the single air supply being disposed above the surface of the water and clear of the water; and the air delivery lines extend above the surface of the water from the air supply to the aerators.

13. The buoyant aerator array according to claim 10, further comprising a floating vessel remotely disposed from the aerator array, the air supply being disposed upon the floating vessel, the air supply including a compressor, a power source selectively driving the compressor, and an air tank, the air supply being disposed above the surface of the water and clear of the water, the air delivery lines extending above the surface of the water from the air supply to each of the aerators of the aerator array.

14. A buoyant aerator adapted for buoyant placement upon the surface of a body of water, the body of water having a floor and being adjacent to a land mass, the aerator comprising:

a toroidal float having a periphery;

a plurality of support legs depending from the float periphery, each of the support legs having an upper attachment end and an opposite lower end;

a flexible anchor cable extending from the upper attachment end of each of the support legs;

a footpad disposed upon the lower end of each of the support legs;

an air delivery column disposed substantially vertically and concentrically through the float, the air delivery column having an upper end and an opposite lower end disposed below the float and above the footpads of the support legs;

an aeration outlet immovably affixed to the lower end of the air delivery column;

an air supply remotely disposed from the air delivery column; and an air delivery line extending from the air supply to the upper end of the air delivery column.

15. The buoyant aerator according to claim 14, wherein each of the support legs has a fixed length, the upper attachment end of each of the support legs being rigidly affixed to the periphery of the float.

16. The buoyant aerator according to claim 14, wherein the aerator has three equally spaced support legs of fixed length, the aeration outlet comprising a plurality of radially disposed tubes.

17. The buoyant aerator according to claim 14, further comprising at least one support column supporting the air delivery line, the at least one support column being anchored and immovably affixed.

18. The buoyant aerator according to claim 14, wherein:

the air supply is disposed upon the land mass remote from the aerator, the air supply including a compressor, a power source selectively driving the compressor, and an air tank, the air supply being disposed above the surface of the water and clear of the water; and the air delivery line extends above the surface of the water from the air supply to the aerator.

19. The buoyant aerator according to claim 14, further comprising a floating vessel remotely disposed from the buoyant aerator, the air supply being disposed upon the floating vessel, the air supply including a compressor, a power source selectively driving the compressor, and an air tank, the air supply being disposed above the surface of the water and clear of the water, the air delivery line extending above the surface of the water from the air supply to the buoyant aerator.

20. The buoyant aerator according to claim 14, wherein the aeration outlet comprises a central plenum having a plurality of aeration tubes extending radially therefrom and a concentric reinforcement brace connecting the tubes to one another.

* * * * *